US005185506A

United States Patent [19]

Walters

[11] Patent Number: 5,185,506

[45] Date of Patent: Feb. 9, 1993

[54] SELECTIVELY MICROWAVE-PERMEABLE MEMBRANE SUSCEPTOR SYSTEMS

[75] Inventor: Glenn J. Walters, Duxbury, Mass.

[73] Assignee: Advanced Dielectric Technologies, Inc., Taunton, Mass.

[21] Appl. No.: 755,629

[22] Filed: Sep. 5, 1991

Related U.S. Application Data

[63] Continuation-in-part of Ser. No. 641,533, Jan. 15, 1991.

[51] Int. Cl.[5] ..... H05B 6/80

[52] U.S. Cl. ..... 219/10.55 E; 219/10.55 F; 426/107; 426/234; 426/243; 99/DIG. 14

[58] Field of Search ..... 219/10.55 E, 10.55 F; 426/107, 234, 243, 113; 99/DIG. 14

[56] References Cited

U.S. PATENT DOCUMENTS

| | | | |
|---|---|---|---|
| 4,258,086 | 3/1981 | Beall | 219/10.55 R |
| 4,662,969 | 5/1987 | Wang et al. | 219/10.55 M |
| 4,771,155 | 9/1988 | Yaugas | 219/10.55 E |
| 4,814,568 | 3/1989 | Keefer | 219/10.55 E |
| 4,883,936 | 11/1989 | Maynard et al. | 219/10.55 E |
| 4,904,836 | 2/1990 | Turpin et al. | 99/DIG. 14 |
| 4,927,991 | 5/1990 | Wendt et al. | 219/10.55 E |
| 4,962,000 | 10/1990 | Enslader et al. | 219/10.55 E |
| 4,962,293 | 10/1990 | Lackey | 219/10.55 |
| 5,006,405 | 4/1991 | Watkins et al. | 428/323 |
| 5,038,009 | 8/1991 | Babbitt | 219/10.55 E |
| 5,059,279 | 10/1991 | Wilson | 156/651 |
| 5,059,436 | 10/1991 | Clark | 426/107 |

*Primary Examiner*—Bruce A. Reynolds
*Assistant Examiner*—Tuan Vinhto
*Attorney, Agent, or Firm*—Wolf, Greenfield & Sacks

[57] ABSTRACT

A selectively permeable membrane microwave susceptor for use in food packaging is disclosed. The susceptor comprises a substrate having at least one absorbing coating and at least one reflecting coating deposited thereon. Either one or both of the absorbing coating or the reflecting coating can be varied to control the amount of microwave energy reaching the absorbing coating, thereby controlling the overall amount of susceptor heating.

44 Claims, 7 Drawing Sheets

SELECTIVELY MICROWAVE-PERMEABLE MEMBRANE SUSCEPTOR SYSTEMS

The present application is a continuation-in-part of co-pending application Ser. No. 07/641,533 entitled "Selectively Microwave-Permeable Membrane Susceptor Systems", filed Jan. 15, 1991, the entire contents of which are expressly incorporated herein by reference.

FIELD OF THE INVENTION

The present invention relates to microwave susceptors for use in packaging of microwaveable food products wherein the susceptor is designed to provide a predetermined reflectivity, transmissivity and absorbance of microwave radiation.

BACKGROUND OF INVENTION

Microwave ovens are well known devices for quickly and conveniently heating foods. However, microwave cooking is known to be unsatisfactory for a variety of food items, and particularly for food items requiring browning or crisping by surface heating. Microwave cooking relies upon dielectric heating of foods responsive to microwave radiation; thus, the heating characteristics in a microwave oven for some food products are dramatically different from those experienced in a conventional oven. Additionally, the use of microwave ovens can result in undesirable temperature differentials for a variety of food products. For example, some food products, when cooked in a microwave oven, will heat to a greater extent on the interior of the product rather than on the surface as a result of the dielectric microwave heating which favors heating of the product interior. This effect can be contrasted with the results of cooking in a conventional oven in which crisping or browning is achieved by exterior heating of the food item.

Furthermore, an additional problem encountered with microwave cooking is the migration of moisture contained on the interior of the food product. Specifically, in many food products, microwave radiation causes moisture contained on the interior of the food product to migrate to the product surface during cooking. The resulting food product is often left with a soggy surface that is generally undesirable in that it imparts an unsatisfactory texture and taste to the food product.

The above problems are well known in the art of microwave cooking and numerous attempts have been made to solve them. For example, various packages for microwaveable food include susceptor which undergo an increase in temperature in response to microwave radiation. Such microwave susceptors generally comprise a thin metal electrode, usually aluminum, deposited upon the surface of a substrate. The surface resistivity of these susceptors is typically in the range of about 10–500 ohms per square.

The film susceptors described above often suffer performance and physical deterioration when exposed to microwave radiation. This deterioration is a result of very rapid heating which occurs during the early stage of the heating cycle. This heating causes the substrate to undergo dimensional changes which damages the metal electrode on the substrate surface. When this electrode damage and deterioration occurs, these susceptors become less reflective, more transmissive and less absorptive to microwave radiation during heating in the microwave oven and, in so doing, experience dramatic, uncontrolled changes in heating performance. Additionally, such uncontrolled susceptors have raised concerns about chemicals leaching from the substrate or adhesives thereon into the food product, as a result of the high temperatures which occur in the susceptor during the early stages of the heating cycle. Thus, it would be very desirable to provide susceptors in which microwave power is reflected, transmitted and absorbed in a predetermined combination and which would have better temperature stability, lower temperature performances, and improved consistency in transmission, reflectivity and absorption throughout its exposure to microwave radiation during cooking.

Among the susceptors that are currently used in microwave cooking, a number of other significant problems exist. For example, current susceptors often result in a nonuniform heating of the food product. Such susceptors often produce a food product that is overheated and overcooked in some regions and underheated and uncooked in other regions. Such problems are particularly evident in large food items such as pizzas, pies, turnovers and the like.

Furthermore, prior art susceptors generally suffer from a lack of control of temperature of the susceptor itself. In prior art susceptors, the only controllable variables to effect the temperature rise have been the initial resistivity of the susceptor electrode and the substrate material. However, when subjected to microwave radiation, such susceptors are known to undergo physical changes resulting from the heating of the susceptor which causes the substrate to shrink or expand with the result that the metal electrode on the substrate surface is damaged. The damage of the metal electrode layer on the susceptor surface results in a significant decrease in microwave energy absorption and a corresponding increase in susceptor transmission of microwave radiation, thereby resulting in a significant decrease in the heating performance of the susceptor upon the outside of the food product combined with increased induction heating performance resulting from the increase in microwave transmission into the food product.

At least one successful attempt has been made in the prior art to control the damage to the susceptor and to enhance susceptor performance by using the susceptor in combination with a separate, reflecting grid to control the amount of microwave radiation that reaches the susceptor surface. This attempt is described in detail in U.S. Pat. No. 4,927,991 to Wendt, et al. the disclosure of which is incorporated herein by reference. Although addressing a number of significant issues relating to the deficiencies of prior art microwave susceptors, the product described in the Wendt et al. patent suffers by requiring a very costly and complex addition to the microwaveable food package and by creating an inherent arcing possibility at the site of any nicks or sharp edges in such reflecting foil grids.

Thus, a significant need exists for a simple, inexpensive microwave susceptor for use in food packaging that will heat evenly in a predictable manner and will experience no more than minimal deterioration when subjected to microwave radiation during the cooking cycle.

SUMMARY OF THE INVENTION

The present invention relates to a membrane type microwave susceptor system comprising at least one substrate having opposed surfaces upon which at least one of the surfaces is deposited at least one absorbing coating adapted to primarily absorb microwave radiation to generate heat, and at least one selectively permeable reflecting membrane or coating adapted to reflect a predetermined amount of microwave radiation. The reflecting coating(s) is deposited proximate to at least one of the opposed susceptor surfaces and designed to have known reflectance and transmittance characteristics for microwave energy, thereby reducing the amount of microwave radiation that contacts the absorbing coating. This results in the ability to control the degree of heating of the susceptor and reduces the likelihood of susceptor failure due to overheating or uncontrollably rapid heating. Thus, by using reflective coatings as microwave energy barriers, susceptor membranes having varying degrees of microwave permeability can be fabricated. Such selectively permeable membranes are characterized by the ability to inherently protect an absorbing coating deposited thereon, or a food product located adjacent to the membrane from excessive microwave energy and inductive heating resulting therefrom, while simultaneously providing a source of conventional, convective or conductive, infrared heating to the food product.

The coatings may be deposited on the same or on opposite sides of the substrate and can comprise the same or different materials. When deposited on opposite sides of the substrate, susceptor deformation and failure is further reduced by providing a susceptor which undergoes a more uniform heating on both sides of the substrate and thereby reduces the likelihood of deformation caused by differential expansion or contraction of the substrate at a localized substrate surface.

In one embodiment, the reflecting coatings are deposited on opposite sides of the substrate and comprise noncontiguous metallic elements. The elements on opposite sides are not aligned and are in so-called "phased array".

In another embodiment, coatings are deposited on one or opposite sides of the substrate and are patterned in a pinwheel type configuration.

The invention further relates to a receptacle for microwave cooking of foods. The receptacle includes the membrane susceptor of the invention. The membrane susceptor is affixed to at least part of the receptacle. The receptacle optionally includes the food item to be cooked. The susceptor comprises at least one substrate upon which is deposited at least one microwave absorbing coating, the coating designed to generate heat. At least one selectively permeable reflecting coating is also deposited on the substrate.

Additionally, the present invention eliminates the need to provide a separate grid for controlling the amount of microwave energy that reaches the susceptor surface. The present invention results, rather, in a selectively permeable membrane susceptor system having performance characteristics substantially equal to or better than those of the prior art grid and susceptor combinations.

DETAILED DESCRIPTION OF THE INVENTION

Figure 1:
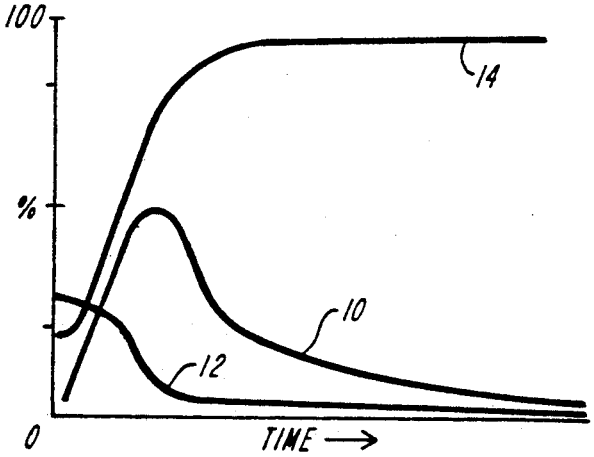
FIG. 1 (PRIOR ART)
FIG. 1 is a graph depicting schematic curves for reflected, transmitted and absorbed microwave energy for a conventional microwave susceptor.

Performance of known susceptors is depicted in FIG. 1, which is a schematic representation of the reflected power, transmitted power and absorbed power for a typical microwave susceptor of the prior art.

Typical prior art susceptors are made by depositing a thin film of metal upon a polyester substrate using any of a number of known metal deposition techniques. When exposed to microwave radiation, the metal coating of the susceptor will absorb the radiation and rapidly become relatively hot. This large, rapid heat load can produce dimensional changes in the substrate, such as shrinkage. These dimensional changes often result in cracks or other discontinuities forming in the metal coating and these cracks or discontinuities result in conductivity breaks in the metal film. This process, referred to herein as electrode breakup, is believed to be associated with irreversible changes which occur in the performance characteristics of the susceptor. When such film breakup occurs, the percentage of microwave power which is reflected, transmitted and absorbed changes, generally resulting in an increased transmittance and a corresponding decrease in the absorption of microwave energy by the susceptor. As microwave energy absorption in the susceptor is decreased, heating of the susceptor will decrease and performance of the susceptor as a browning and crisping mechanism for food products will decrease as well.

In a conventional susceptor, a schematic curve for absorbed power for a susceptor is identified by reference numeral 10 in FIG. 1. In the absorbence curve 10 depicted in FIG. 1, the percentage of absorbed power peaks at about 0.5 or 50%, for a susceptor having a surface resistivity of approximately 125–175 ohms per square. The transmitted power for such a susceptor will generally follow the schematic curve identified by reference numeral 12 in FIG. 1. Reflected power for the susceptor will generally follow the schematic curve identified with reference numeral 14.

As shown in FIG. 1, microwave absorbence 10 will peak and then decrease to approximately 5–10% of the microwave energy field. This effect is the result of film damage which occurs if the susceptor becomes overheated. As the electrode develops cracks or discontinuities, its absorbence decreases and susceptor heating will undergo a corresponding decrease. The microwave reflectance 12 decreases significantly once film damage occurs. Thus, as discontinuities develop in the film and electrode, more microwave energy passes through the susceptor. The reflectance curve 12 is seen to change significantly at the time of peak absorbence. Reflectance generally will vary from about 30% at the start of the cooking cycle to about 5% following film breakup. The microwave transmittance 14 increases significantly with decreases in absorbence and reflectance. Transmission will vary from about 20% at the start of the cooking cycle to about 90% following film breakup.

When the absorbence, reflectance and transmittance properties of prior art susceptors change during microwave cooking cycles, such changes generally result in decreased and very different cooking performances of the susceptor. Initially, the susceptor will overheat. This tends to cause film breakup and may result in the volatilization of chemical species from the substrate or adhesives thereon. The volatilization is undesirable in that it may impart chemicals to the food surface which can affect the taste, appearance or fitness of the food product for consumption. The breakup of the metal film layer in a conventional susceptor is known to increase the surface impedance and, in so doing, results in a decreased heating of the susceptor. Thus, it can be seen in FIG. 1 that the percentage of power transmitted through the susceptor increases significantly during the microwave process while the reflected power and absorbed power both significantly decrease resulting in a significant decrease of the heating of the susceptor.

The change in the performance characteristics of the susceptor is undesirable in many applications in which crisping or browning of a microwaveable food product is desired because it increases the amount of dielectric heating in the interior of the food product while decreasing the amount of thermal heating on the food surface. Thus, it would be desirable to have a mechanism for maintaining the susceptor in a state such that the reflected, transmitted and absorbed power characteristics are relatively unchanged and can remain at predetermined levels throughout the microwave cooking cycle. These effects have been achieved by using the inventive susceptors described herein.

Figure 2:
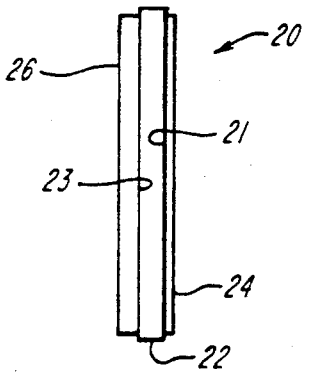
FIG. 2 is a cross-sectional schematic representation of a microwave susceptor having an absorbing film and a reflecting film.

As depicted in FIG. 2, one embodiment of the susceptor 20 of the present invention comprises a substrate 22 having opposed first and second surfaces 21, 23 upon the first surface of which is deposited a first coating 24 for absorption of microwave radiation and upon the second surface of which is deposited a second coating 26 for reflection of a portion of the microwave radiation to which the susceptor is exposed. By varying the reflectivity of coating 26, a membrane is created which is selectively permeable to microwave energy—i.e., it has the ability to control the amount of microwave energy reaching the absorbing coating 24. In each case, coatings 24 and 26 can be applied by any deposition process, which will not damage the substrate or the deposited coating. In one embodiment, a vapor deposition process which can be any process in which materials are deposited upon substrates from the vapor phase, is preferred. Deposition methods such as chemical and physical vapor deposition (CVD, PVD) which include sputtering, ion plating, electroplating electron beam and resistive or inductive heating are intended to be included herein. It is pointed out that while methods for providing the electrode material in the vapor phase are preferred, the invention is not intended to be limited as such. Rather, any method for applying microwave absorbing and reflecting coatings can be used, provided the method does not damage the substrate upon which the coatings are being deposited during the deposition process.

The absorbing coating 24 preferably has a resistivity in the range of about 30 to about 500 ohms per square. A variety of electrically conductive materials can be used to form the absorbing electrode 24. As such, the absorbing electrode 24 can comprise a coating of a single metal, a metal alloy, a metal oxide, a mixture of metal oxides, a dispersion of conductive metallic or nonmetallic materials in a binder, or any combination of the foregoing. Suitable exemplary metals include aluminum, iron, tin, tungsten, nickel, stainless steel, titanium, magnesium, copper and chromium. Suitable exemplary metal oxides include oxides of aluminum, iron and tin; however, if not electrically conductive, (for example aluminum oxide), they must be used in combination with an electrically conductive material. Suitable exemplary dispersion materials include carbon black, graphite, powdered metals and metal whiskers.

The selectively permeable reflecting coating 26 preferably has a resistivity in the range of about 10 to about 150 ohms per square and, as in the case of the absorbing coating 24, can be any of a wide variety of materials including metals or metallic alloys, oxides or mixtures thereof either alone or as a dispersion in a binder. Preferably, the reflecting film 26 comprises a metal having a higher bulk resistivity than elemental aluminum, thereby allowing an electrode layer that is twice as thick for a given resistivity as compared to elemental aluminum. A thicker film for the reflective layer is preferred because in a thicker layer reflection is favored over transmission and also because, surface oxidation as a percentage of overall film thickness becomes smaller as film thickness is increased. By minimizing the relative percentage of film layer oxidation, performance of the reflective coating is more stable.

The substrate 22 preferably comprises an electrical insulator, e.g. a polymeric film, which can be oriented or unoriented. Materials considered to be useful as the substrate 22 include, for example, polyolefins, polyesters, polyamides, polyimides, polysulfones, polyether ketones, cellophanes and various blends of such materials. Other nonconducting substrate materials such as paper and paper laminates, metal oxides, silicates and cellulosics can be used as well. In one embodiment, the substrate 22 comprises a polyester film of the order of approximately 0.25 mil to approximately 2 mil thick. A thickness of approximately 0.5 mil is preferred.

The embodiment of FIG. 2 is particularly well suited for preventing film breakup of the susceptor for two reasons. First, since a significant portion of microwave energy is reflected by the selectively permeable reflecting coating 26, the absorbing coating 24 does not get as hot, and the substrate 22 is less likely to undergo heat induced deformation or chemical volatilization. Second, since the films are deposited on opposite sides of the substrate they tend to serve to physically impede substrate shrinkage. Thus, the combination of controlled heating effects and physical restraint of the polymeric substrate 22 caused by coating layers 24 and 26 results in an improved susceptor which provides more constant heating characteristics and is less prone to deterioration caused by substrate deformation when exposed to microwave radiation.

Figure 3:
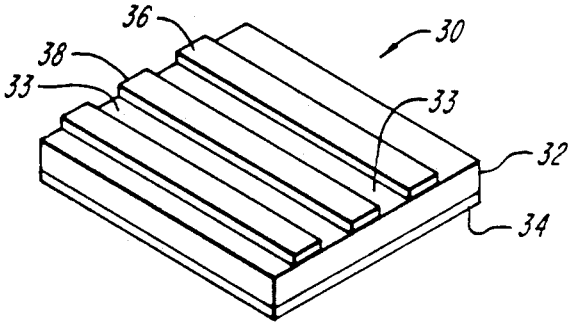
FIG. 3 is a schematic, perspective representation of one embodiment of a microwave susceptor having a discontinuous reflecting film.

In another embodiment of the invention depicted in FIG. 3, the susceptor 30 includes a microwave reflecting film disposed as a series of separate patterns 36, 38 deposited upon a surface of the polymeric substrate 34. The regions 36, 38 can be in the form a series of parallel stripes, circles or other patterns, or they can be of some other configuration to allow portions of the microwave field to contact directly the polymeric substrate 32, and consequently, the absorbing coating 34, without being reflected by the reflecting coating regions 36, 38. By selecting the particular material of the reflecting coating regions 36, 38, as well as the physical dimensions of the regions such as coating pattern, thickness, width and pitch, it is possible to control both the degree to which the reflective coating regions 36, 38 will reflect microwave energy and the amount of energy that is transmitted through the polymeric substrate 32 in the spaces 33 between the regions 36, 38 of reflecting material.

Figure 4:
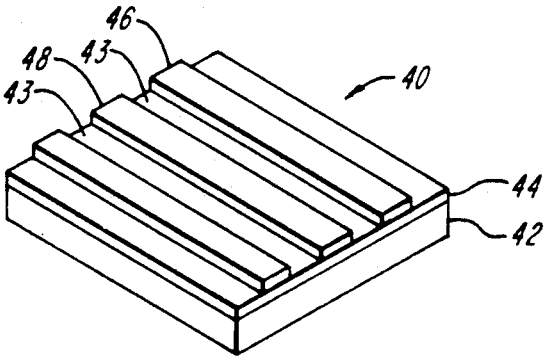
FIG. 4 is a schematic, perspective representation of a second embodiment of a microwave susceptor having a discontinuous reflecting film.

In still another embodiment of the invention depicted in FIG. 4, the susceptor 40 includes a microwave reflecting coating comprising separate regions 46, 48 of reflecting coating applied directly to the surface of the absorbing electrode coating 44 once the absorbing electrode has been deposited upon a surface of the polymeric substrate 42. In this embodiment, regions of the reflecting coating 46, 48 are deposited directly upon the microwave absorbing coating 44 in a manner such that spaces 43 of the absorbing coating 44 are exposed in the areas between the reflecting regions 46 and 48. As before, by selecting a specific material, thickness, width and pitch of the reflecting regions, the amount of the field of the microwave field that is reflected relative the amount of the field that is transmitted can be highly controlled.

Alternatively, the embodiment of the invention depicted in FIG. 4 can be fabricated by a process in which a relatively thick reflective coating is deposited upon one surface of the substrate and then selectively and partially removed using any of a variety of removal techniques to remove portions of the reflective coating. The coating removal can be either complete of (i.e. down to the substrate surface), or partial (i.e. removing only a partial thickness of the reflective coating). If a complete removal technique is used, the resulting substrate will have a patterned reflective coating deposited thereon. On the other hand, if a partial removal process is used, the resulting substrate will have a reflective coating thereon having regions that are relatively thick to reflect microwave energy as well as regions that are relatively thin to absorb microwave energy. This embodiment provides performance characteristics that are similar to those of the dual coating susceptor in which both the absorbing and the reflecting coating are deposited upon the same side of the substrate.

Additionally, although the embodiment depicted in FIG. 4 does not include material deposited on opposite sides of the polymeric substrate to support the substrate and prevent deformation thereof during microwave heating, the reflective regions serve to limit the amount of microwave energy reaching the absorbing film and thereby prevent the film from overheating and deforming the polymeric substrate or causing volatilization thereof. Thus, susceptor performance is more constant and predictable throughout the cooking cycle.

Although, in each of the embodiments described above, the absorbing coating is a continuous, uniform layer, the present invention is not intended to be limited as such. Rather, the present invention is intended to include susceptors in which either one or both of the absorbing coating and the reflecting coating are provided with a pattern. Accordingly, as with the reflecting layer, the absorbing coating can comprise a series of parallel stripes, circles or other geometric configurations. The pattern of either one or both of the reflecting coating and the absorbing coating can be formed during deposition, or alternatively, the coating can be deposited as a uniform layer with pattern formation occurring during subsequent demetallization steps. Thus, the invention is intended to comprise a susceptor in which the heating performance can be controlled by controlling, among other variables, coating thickness, coating pattern and coating material for both the absorbing coating and the reflecting coating, regardless of whether the two coatings are on the same or opposing sides of the substrate.

In still another embodiment of the invention, both the reflecting and absorbing regions can be designed to have different reflective and absorptive characteristics in different portions of the susceptor. In so doing, different regions of the absorbing layer will receive differing amounts of microwave energy and will, accordingly, heat to different levels. As such, a susceptor of this type is well suited for applications in which it is desired to brown or to crisp different portions of a packaged food product to differing degrees.

Figure 5:
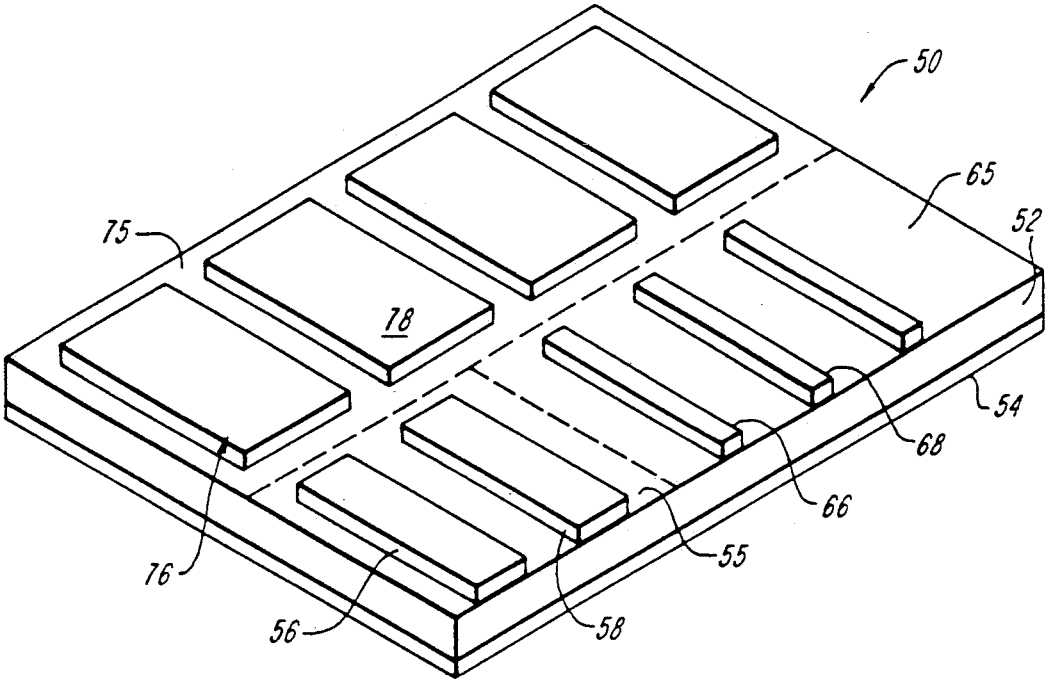
FIG. 5 is a schematic, perspective representation of a microwave susceptor having nonuniform heating characteristics.

One such susceptor is depicted in FIG. 5. In FIG. 5, the susceptor 50 comprises a polymeric substrate 52 having a microwave absorbing coating 54 deposited on one surface thereof. A microwave reflecting coating comprising a plurality of separate, reflecting regions 56, 58, 66, 68, 76, 78 is deposited on the surface of the substrate opposing the surface on which the absorbing film 54 is deposited. In this example, three different zones of reflecting film have been deposited on the substrate to provide three nonuniform heating zones 55, 65, 75 on the susceptor.

A first heating zone 75 is created by depositing large reflecting coating regions 76 and 78 which cover a large surface portion of the substrate. These large regions 76, 78 serve to reflect a large portion of microwave energy and therefore allow a relatively small amount of energy to be absorbed in the absorbing coating 54 in the film portion opposite these large reflecting regions. As such, the susceptor portion having large reflecting regions 76 and 78 will undergo the least amount of heating, and food items positioned adjacent this zone 75 of the susceptor will be subjected to the least amount of browning or crisping.

A second heating zone 65 is created by reflecting regions 66 and 68 which cover a relatively small portion of the substrate area in which such regions are deposited. These small regions 66, 68 serve to reflect only a small portion of microwave energy and therefore allow a relatively large amount of energy to be absorbed in the absorbing electrode coating 54 in the film portion opposite these small reflecting regions. As such, the susceptor portion having small reflecting regions 66 and 68 will undergo the greatest amount of heating. Food items positioned adjacent this zone 65 of the susceptor will be subjected to the greatest amount of browning or crisping.

Finally, a third heating zone 55 is created by reflecting regions 56 and 58 which are of an intermediate size between the large reflecting portions 76 and 78 and the small reflecting portions 66 and 68. Accordingly, food items positioned adjacent to the susceptor in heating zone 55 will undergo an amount of browning or crisping that is between that produced by zones 76 and 66. For example, a susceptor of this type could be used in a frozen dinner having a three different food types to heat each food type to a particular degree. Thus, susceptor heating zone 66 could be positioned in the region over a serving of fried potatoes, thereby allowing the potato surface to be deeply browned; heating zone 75 could be positioned over a serving of vegetables to allow only light cooking thereof; and heating zone 55 could be positioned over a serving of meat to allow an intermediate heating and browning of that serving.

As set forth previously, the differing heating characteristics can be achieved by varying the absorbing layer instead of, or in combination with, providing variations in the reflecting layer. Thus, by patterning the absorbing layer differently in differing heating zones, a nonuniform susceptor heating characteristic can be achieved.

In another embodiment of the invention, the differing heating zones can have a circular configuration. Thus, for example, if it were desired to brown an annular region of a food item, such as the crust of a pizza, the susceptor could be configured to have a center portion that absorbs a higher portion of microwave energy than an annular portion of the susceptor surrounding the center. This configuration would allow a greater percentage of microwave energy to reach the absorbing coating in the annular region, thereby allowing greater heating of the center portion of the susceptor and providing a higher browning heat to the center portion of the pizza.

Figure 6:
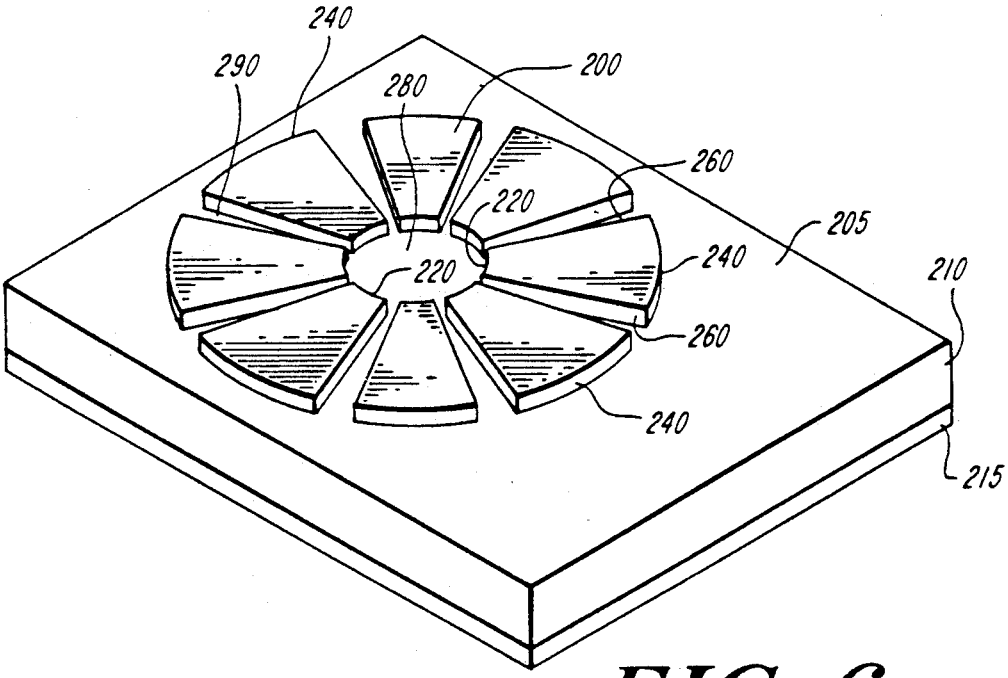
FIG. 6 is a schematic, perspective representation of a microwave susceptor having a discontinuous reflecting film in a pinwheel pattern.

FIG. 6 illustrates a particular embodiment of the susceptor which is designed to spatially distribute microwave energy by focusing the energy at one or more particular points. The so called "pinwheel" pattern illustrated in FIG. 6 comprises a plurality of elongated metallized elements 200 that are deposited upon a surface 205 of a microwave transparent polymeric substrate 210, opposite to a microwave absorbing coating 215. These elongated elements 200 are roughly trapezoidal in shape. Each trapezoidal element has an inner lateral side 220 that is substantially shorter in length than a corresponding outer lateral side 240. These respective inner and outer lateral sides are connected by longitudinal sides 260 of approximately equal length. The metallized elements are arranged adjacent to one another so that the respective inner lateral sides define a central, nonmetallized area 280 roughly circular in shape. The adjacent longitudinal sides 260 are separated from each other by nonmetallized gaps 290 and, as illustrated, the resulting configuration resembles a pinwheel pattern with spokes (i.e. the elongated elements 200) radiating outwardly from a central hub (i.e. the element free central area 280).

In preferred embodiments, the central, nonmetallized area 280 defined by the inner lateral sides 220 of the metallized elements 200 is less than about one inch in diameter although it can be larger. Generally, the diameter of the central area is substantially the same as the length of the metallized elements as defined by their longitudinal sides 260. The particular pattern illustrated in FIG. 6 and equivalents thereof tend to focus microwave energy at the central, metal-free area and a food item or a portion of a food item is conveniently placed under the central area 280.

Specifically, individual elements of this particular pattern can focus microwave energy to eliminate cold spots within a microwave field. In one embodiment, the inner lateral sides 220 of the metallized elements are about 5 mm wide and the outer lateral sides 240 are about 10 mm wide, the sides being connected by a longitudinal length of about 60 mm. In a pinwheel pattern of this size, the central area can be as large as 75 mm. The number of radiating metallized elements can also preferably vary from about 5 to as many as 36, depending upon the size of the central area. A constraint upon the number and width of metallized elements in the pinwheel pattern of FIG. 6 is the difficulty in maintaining nonmetallized gaps 290 adjacent the inner lateral sides 220 of the pattern as the number of radiating elements 200 increases.

It is noted that the above, nonuniform susceptors are not intended to be limited strictly to the embodiments described above. Rather, any number of separate heating zones can be created on the susceptor. Furthermore, the differing heating zones can be created by altering any of the variables discussed herein. Thus, each selectively permeable membrane coating could be of the same dimensions, but of materials having different reflective properties. Alternatively, the reflecting films could be of the same material but could be deposited to have different patterns thicknesses, widths or pitches. Additionally, as set forth in the embodiment of FIG. 4, the different reflecting coating portions could be deposited directly upon the surface of the absorbing coating.

The invention is not intended to be limited solely to a susceptor having a single absorbing coating and a single, selectively permeable reflecting coating. Rather the inventive susceptor is intended to include systems having multiple absorbing and/or reflecting coatings. Thus, the invention will include a susceptor having an absorbing coating on both sides of the substrate with a single reflecting layer on one absorbing coating, a susceptor having an absorbing coating on one side of the substrate with reflecting coatings covering both the absorbing coating and the opposing side of the substrate, and a susceptor having both an absorbing coating and a reflecting coating on each side of the substrate.

Figure 7:
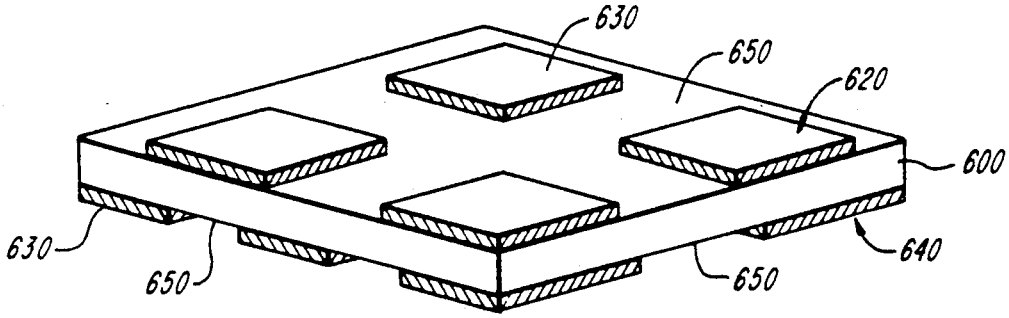
FIG. 7 is a schematic, perspective representation of a phased array reflective coating of the invention.

For example, in one embodiment, the reflecting coatings include a single planar substrate sandwiched between two reflective layers. Each microwave reflective layer includes a discontinuous patterned coating that is separated from each other by nonreflective areas, as described above. In a preferred configuration of this reflective coating, the respective patterned coatings are in "phased array". One microwave reflective pattern layer is displaced relative to the other layer so that some or all of the pattern coatings are not substantially aligned. This can best be illustrated by reference to FIG. 7. An insulative substrate 600 is sandwiched between two microwave-reflective coatings 620, 640. Each coating comprises a plurality of reflective patterns 630 separated from each other by nonreflective areas 650. The layers 620, 640 are horizontally displaced relative to each other. Microwave energy impinging upon one of the coatings will be completely or partially reflected from the structure, depending upon the relative displacement of the microwave reflective coatings.

Figure 8:
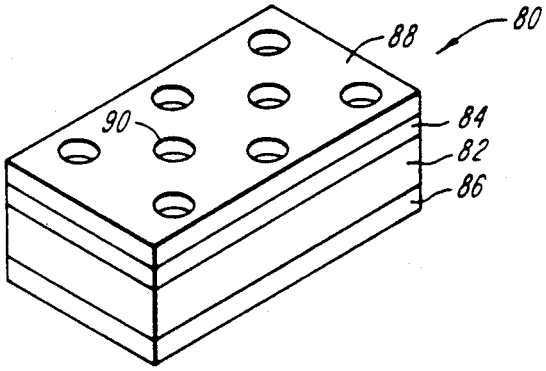
FIG. 8 is a schematic, perspective representation of a microwave susceptor having multiple absorbing coatings and a single reflecting coating.

FIG. 8 depicts a susceptor 80 having a substrate 82 upon which are deposited absorbing coatings 84, 86 on opposing sides of the substrate. A selectively permeable reflecting coating 88 is deposited on absorbing coating 84. In this embodiment a pattern comprising a plurality of circular cutouts 90 has been provided on the reflecting coating 88.

Figure 9:
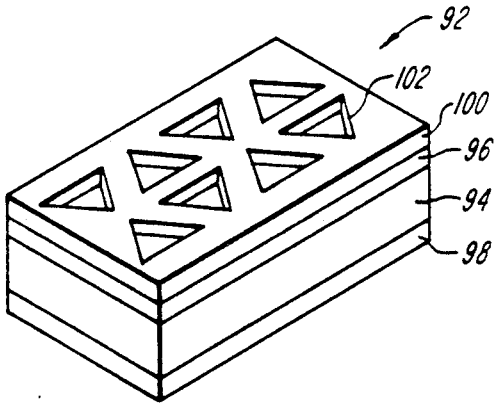
FIG. 9 is a schematic, perspective representation of a microwave susceptor having a single absorbing coating and multiple reflecting coatings.

FIG. 9 depicts a susceptor 92 having a substrate 94 upon which is deposited an absorbing coating 96 as well as two selectively permeable reflecting coatings 98, 100. Coating 100 has been patterned by providing a plurality of triangular cutouts 102. Reflecting coating 98 may be patterned, if at all, in a similar or different manner.

Figure 10:
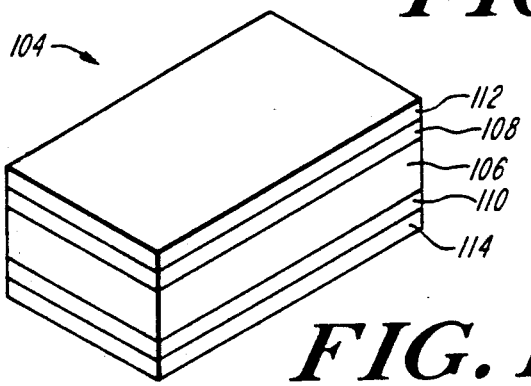
FIG. 10 is a schematic perspective representation of a microwave susceptor having multiple absorbing and reflecting coatings.

FIG. 10 depicts a susceptor 104 having a substrate 106 upon which are deposited two absorbing coatings 108, 110 and two selectively permeable reflecting coatings 112, 114.

Figure 11:
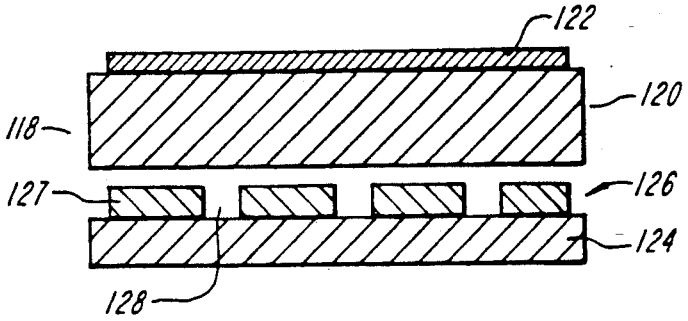
FIG. 11 is a cross sectional representation of a microwave susceptor having multiple substrates.

Further embodiments contemplate use of two insulative substrates; upon one of which is deposited at least one absorptive coating and upon the other of which is deposited at least one reflective coating. The substrates are preferably made of different materials. FIG. 11 depicts a susceptor 118 having two different substrates 120, 124. Substrate 120 has deposited thereon a microwave absorptive layer 122 and substrate 124 has deposited thereon a microwave reflective layer 126, comprised of a plurality of patterned reflective regions 127 separated by nonreflective areas 128. It will be readily appreciated that many variations of the susceptor of FIG. 11 can be developed according to the invention. For instance, coating 126 could be continuous; substrate 120 could have both surfaces coated with absorptive layers; substrate 124 could be affixed directly to substrate 120, and the like. It will also be appreciated that separate layers of the laminated susceptors described herein can be affixed to each other using well known adhesives described in the art. See for example, U.S. Pat. No. 4,911,960 (Mudge et al.). Exemplary adhesive materials include but are not limited to, water-based adhesives, blends of ethylene, vinylacetate, vinylacetate-acrylic latex and combinations thereof.

Figure 12:
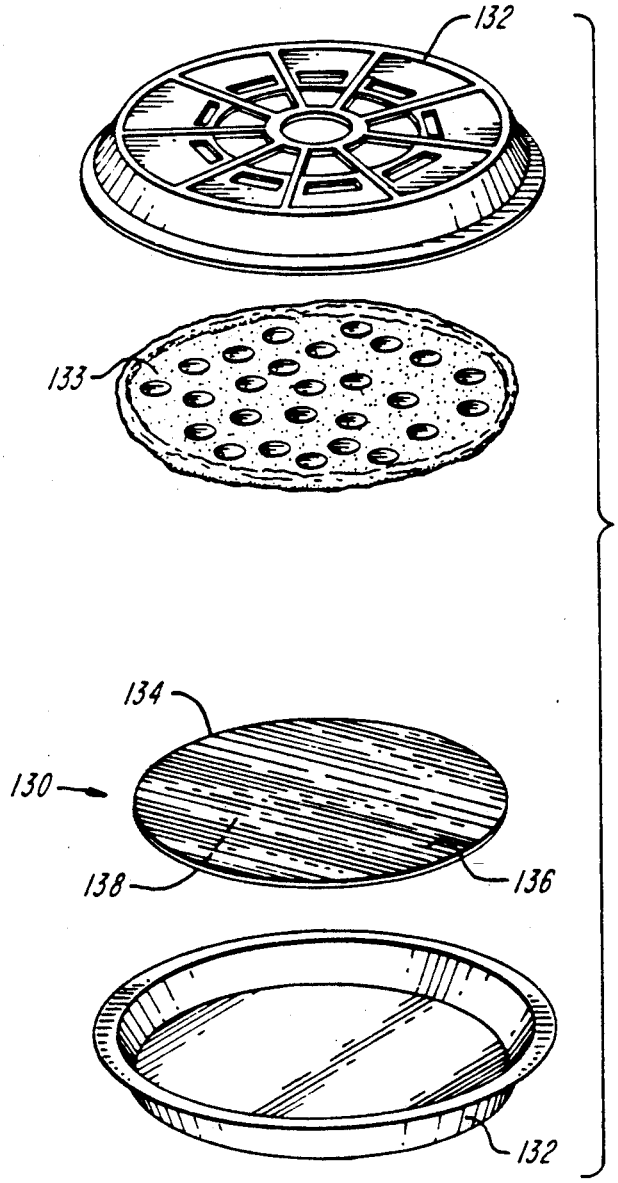
FIG. 12 is a representation of a food packaging system of the invention.

The susceptor membrane of the invention can be incorporated into a food packaging system for use in microwave ovens. As illustrated in FIG. 12, a susceptor membrane 130 of the invention can be incorporated into any standard microwave container or receptacle 132. The susceptor can be any one of the configurations described herein. In this particular embodiment, the susceptor includes an insulative substrate 134 onto one surface of which is deposited a reflective, patterned coating 136. The other surface of the susceptor has deposited on it an absorptive layer 138. The susceptor membrane 130 can be positioned in a variety of configurations within the packaging system and does not have to be in direct contact with the food 133. Various configurations for microwave food packaging systems are well-known. See for example, U.S. Pat. No. 4,940,867 (Teleg), U.S. Pat. No. 4,190,757 (Turpin) and U.S. Pat. No. 4,641,005 (Sieferth) incorporated herein by reference. Other receptacles can readily be developed by those skilled in the art without significantly departing from the scope of the invention.

EXAMPLES

Example 1

Figure 13:
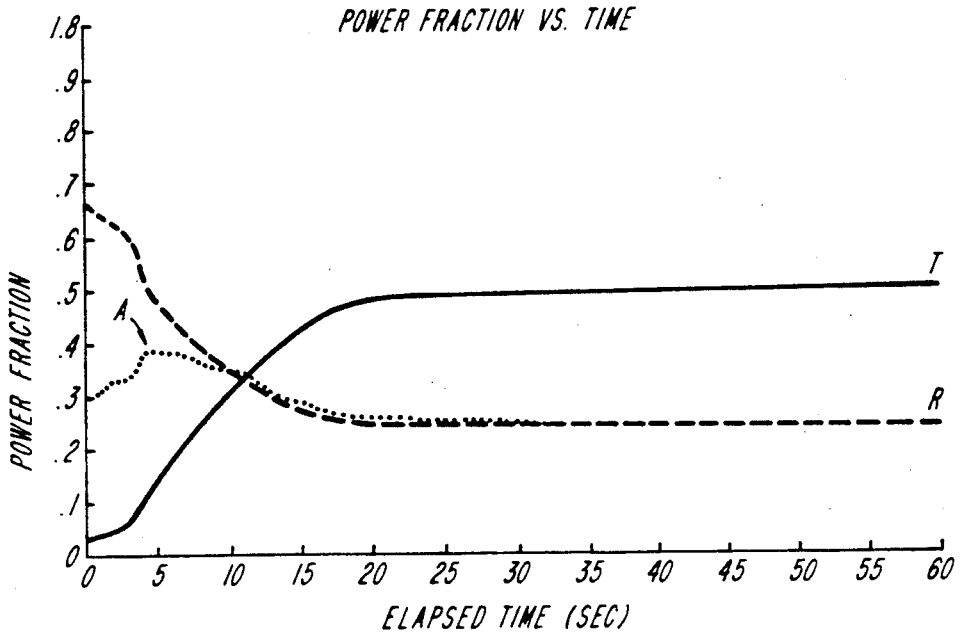
FIG. 13 is a graph plotting reflected, absorbed, and transmitted microwave energy as a function of time for a conventional microwave susceptor film.

In this example, a standard susceptor film was fabricated using a polyester substrate having a thickness of 0.5 mil. Aluminum was coated on one side of the polyester substrate to have an optical density of approximately 0.25 with a resulting surface energy of approximately 75 ohms per square. The susceptor was placed in a microwave test fixture operated at 150 watts and exposed to microwave energy for one minute. FIG. 13 depicts the power fractions of reflected, absorbed, and transmitted microwave energy as a function of time. As can be seen in FIG. 13, the properties of the susceptor begin to change almost immediately, and undergo a continuing change for approximately 20 seconds. Thus, whereas initially the susceptor has a transmissivity of approximately 4%, a reflectivity of approximately 66% and an absorbance of approximately 30%, as the susceptor undergoes breakdown, approximately 25% of the energy is reflected, approximately 25% of the energy is absorbed and approximately 50% of the energy is transmitted through the susceptor.

Figure 14:
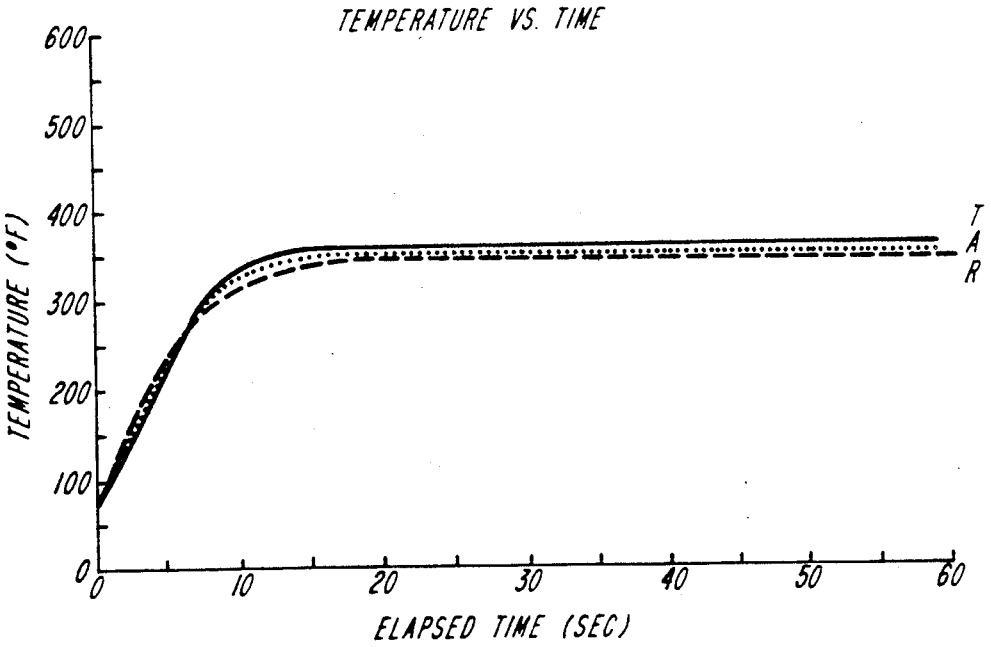
FIG. 14 is a graph plotting temperature performance as a function of time for a conventional microwave susceptor film.

The result of this susceptor breakdown can be seen in FIG. 14 in which film temperature in two different regions is plotted as a function of time. In each case, the temperature probes were located on the susceptor film with a separation of approximately one inch. At the beginning of the cooking cycle the susceptor film surface is at a temperature of approximately 75° F. and then rises over the first 20 seconds of the cooking cycle to a temperature of approximately 350° F.

Example 2

In this example, a modified susceptor film having high, constant reflectivity was fabricated. Specifically, a polyester substrate having a thickness of 0.5 mil was coated on one side with an absorbing aluminum coating to an optical density of approximately 0.25. As before, this corresponds to a bulk resistivity or surface energy of approximately 75 ohms per square. The opposite side of the substrate was coated with a pattern which comprised metal stripes of aluminum that were approximately 0.875 inches wide with a spacing between the stripes of approximately 0.2 inches. The stripes were deposited to have a bulk resistivity of approximately 25 ohms per square.

Figure 15:
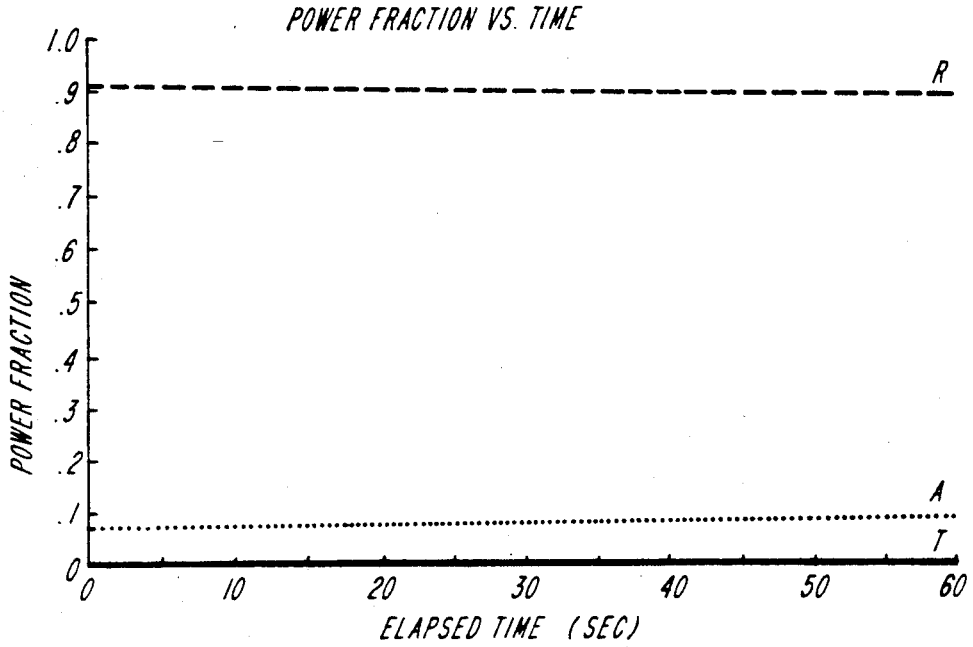
FIG. 15 is a graph plotting reflected, absorbed, and transmitted microwave energy as a function of time for a microwave susceptor film comprising one of embodiment of this invention.

FIG. 15 depicts the power fraction of reflected, absorbed and transmitted microwave energy as a function of time as the susceptor is exposed to microwave energy in a microwave test fixture operated at 150 watts. As can be seen in FIG. 15, the transmitted power of microwave energy using the modified susceptor stays at approximately 0% throughout the heating cycle. The absorbed energy varies from approximately 8% at the beginning of the cycle to approximately 10% at the end of the cycle. Finally, the reflected energy varies from approximately 92% at the beginning of the cycle to approximately 90% at the end of the cycle. Thus, it can be seen that the use of a reflecting coating in connection with the absorbing coating for a microwave susceptor results in a susceptor having reflection, absorption and transmission characteristics that are much more stable and uniform when subjected to microwave energy.

Figure 16:
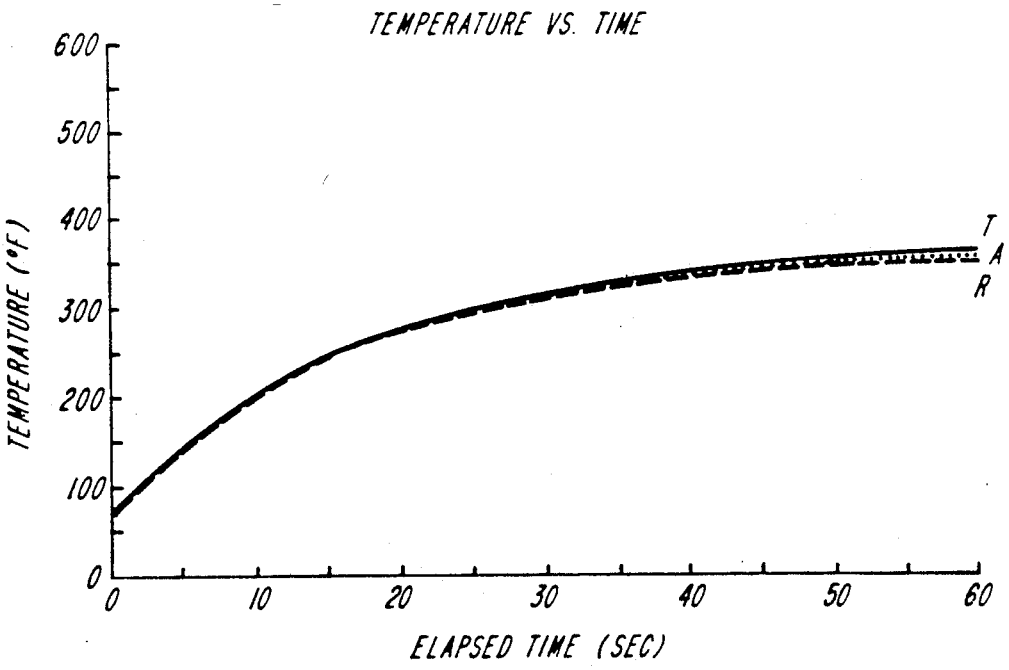
FIG. 16 is a graph plotting temperature performance as a function of time for the susceptor film of FIG. 15.

FIG. 16 depicts a plot of temperature as a function of time for this modified susceptor film. As can be seen in FIG. 16, the substrate temperature undergoes a continuous rise in temperature over the heating cycle of the film. The curve shows two test points taken on the susceptor film surface. However, since both test points were located at similar temperature positions during the test, the resulting heating curves are substantially identical. As can be seen in FIG. 16, initially, the susceptor starts at a temperature of approximately 75° F., rises steadily to a temperature of approximately 250° F. during the first 15 seconds of microwave exposure and then continues with a gradual rise to approximately 350° F. over the remaining 45 seconds of the test.

Example 3

Figure 17:
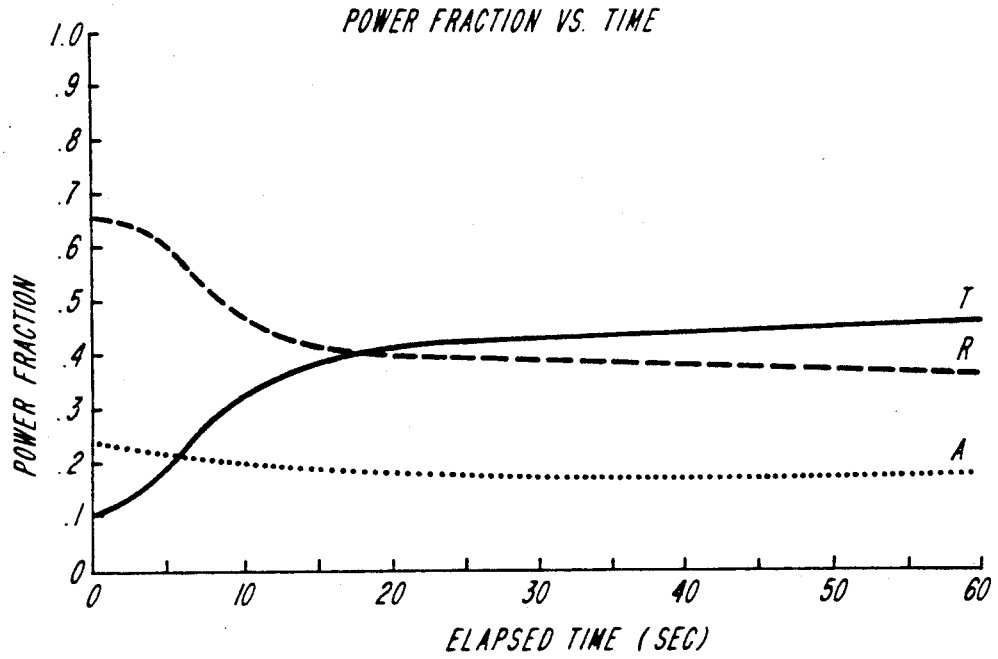
FIG. 17 is a graph plotting reflected, absorbed, and transmitted microwave energy as a function of time for a second embodiment of the microwave susceptor of this invention.

In this example, a susceptor very similar to the susceptor of the previous example was fabricated. The only difference was in the width of the stripes of the reflecting coating. Whereas in the previous example the stripes had a thickness of approximately 0.875 inches, in this example, the reflecting stripes each had a width of approximately 0.27 inches. As before, the separation between the stripes was approximately 0.2 inches. As can be seen in FIG. 16, a plot of power fraction versus time, even the use of thin reflecting stripes will dramatically alter the power fraction curves for reflected, absorbed and transmitted microwave energy as compared to those curves for a conventional microwave susceptor. Thus, as shown in FIG. 17, the portion of microwave energy that is transmitted using this susceptor starts at approximately 10%, rises to approximately 40% over the first 15 seconds of microwave exposure and then gradually rises to approximately 50% over the final 45 seconds of the test. Likewise, at the beginning of the test approximately 25% of the microwave energy is absorbed and this gradually falls off to approximately 15% over the test cycle. Finally, at the start of the test, approximately 65% of the microwave energy is transmitted. This falls off to approximately 40% in the first 15 seconds of the test and then gradually to approximately 35% over the remaining 45 seconds of the test.

Figure 18:
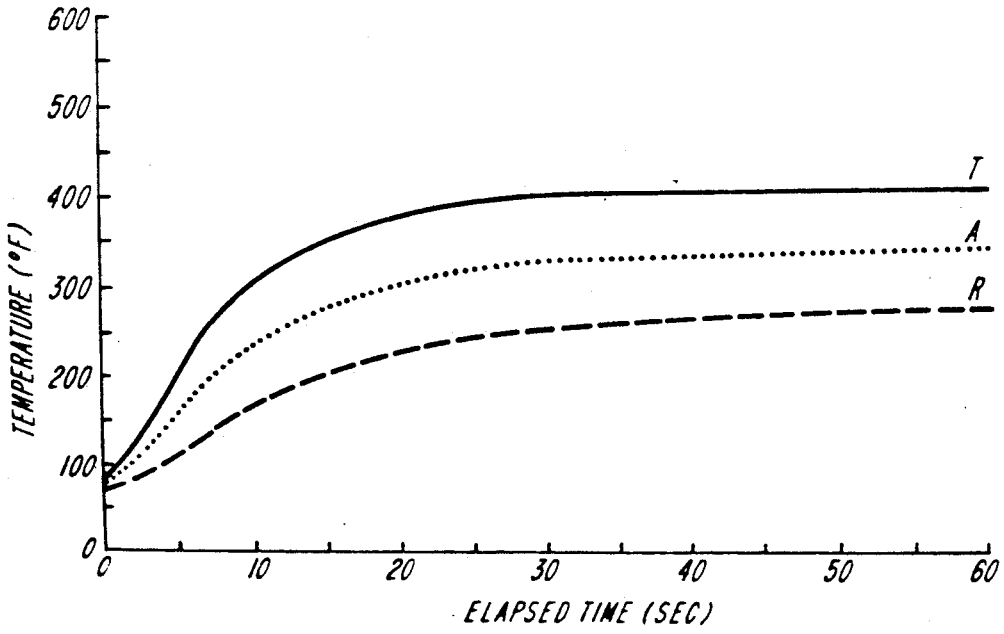
FIG. 18 is a graph plotting temperature performance as a function of time for the microwave susceptor of FIG. 17.

FIG. 18 depicts temperatures as a function of time for the above susceptor as plotted at two different locations on the susceptor film. On curve number 1, which represents the temperature of the susceptor film in a location lying beneath a reflecting stripe, the susceptor temperature starts at approximately 75° F., rises to approximately 225° F. during the first 20 seconds of microwave exposure and then gradually rises to approximately 250° F. over the remaining 40 seconds of the test. In contrast, curve number 2, representative of the temperature of the susceptor in a section which is not covered by a stripe, also begins at approximately 75° F., rises to approximately 375° F. in the first 20 seconds of the test, and then gradually rises to a final temperature of approximately 400° F. in the remaining period of the test.

Thus, as can be seen from FIG. 18, the use of a microwave susceptor having a patterned reflecting coating provides a susceptor that has differing and controllable temperature characteristics in differing regions of the susceptor.

EQUIVALENTS

Although the specific features of the invention are shown in some drawings and not in others, this is for convenience only, as each feature may be combined with any or all of the other features in accordance with the invention.

It should be understood however that the foregoing description of the invention is intended merely to be illustrative thereof, that the illustrative embodiments are presented by way of example only, and that other modifications, embodiments, and equivalents may be apparent to those skilled in the art without departing from its spirit.

Having thus described the invention, what we desire to claim and secure by Letters Patent is:

1. A microwave susceptor for use in food packaging, the susceptor comprising:

a) at least one substantially microwave-transparent substrate, the substrate having opposed surfaces;

b) at least one microwave-absorptive coating disposed as a pattern upon at least one of said opposed surfaces, said microwave-absorptive coating constructed and arranged to absorb microwave energy and generate heat; and c) at least one microwave-reflective coating disposed as a pattern proximate to at least one of said opposed surfaces, said microwave-reflective coating constructed and arranged to reflect microwave energy, to thereby reduce the amount of such microwave energy that reaches the microwave-absorptive coating when the susceptor is exposed to a microwave energy field.

2. A microwave susceptor as in claim 1 comprising at least one substrate with one microwave-absorptive coating and one microwave-reflective coating disposed on opposing surfaces thereof.

3. A microwave susceptor as in claim 1 wherein at least one of said microwave absorptive coating and said microwave reflective coating is a vapor deposited coating.

4. A microwave susceptor as in claim 3, wherein at least one of said microwave reflective coating is disposed in a pinwheel pattern.

5. A microwave susceptor as in claim 3 wherein at least one of said microwave absorptive coating and microwave reflective coating is a vapor deposited coating.

6. A microwave susceptor as in claim 5 wherein the substrate comprises a polymeric film.

7. A microwave susceptor as in claim 1 wherein said microwave reflective coatings that are disposed proximate to at least one of said opposed surfaces of the substrate are in phased array.

8. A microwave susceptor as in claim 1 wherein the substrate comprises a paper or paper laminate.

9. A susceptor as in claim 1 wherein the substrate comprises a cellulosic material.

10. A microwave susceptor as in claim 1 wherein the microwave absorptive coating has a resistivity of between about 30 and about 500 ohms per square.

11. A microwave susceptor as in claim 1 wherein the microwave-reflective coating has a resistivity of between about 10 and about 150 ohms per square.

12. A microwave susceptor as in claim 11 wherein the microwave-absorptive coating comprises elemental aluminum.

13. A microwave susceptor as in claim 12 wherein the microwave reflective coating comprises a metal or metallic alloy having a bulk resistivity higher than that of elemental aluminum.

14. A microwave susceptor as in claim 13 wherein, the microwave reflective coating includes a plurality of regions having differing reflectivities.

15. A microwave susceptor as in claim 13 wherein the microwave absorptive coating includes a plurality of regions having differing microwave energy absorption characteristics.

16. A microwave susceptor as in claim 1 wherein the microwave absorptive coating comprises a metal or metallic alloy.

17. A microwave susceptor as in claim 1 wherein the microwave reflective coating comprises a metal or metallic alloy.

18. A microwave susceptor as in claim 1 adapted to undergo nonuniform heating in the presence of a uniform microwave energy field.

19. A microwave susceptor as in claim 18 wherein the regions having differing reflectivities comprise microwave reflective coatings comprising differing materials.

20. A microwave susceptor as in claim 18 wherein the difference patterning geometries of said microwave reflective coatings are in phased array.

21. A microwave susceptor as in claim 18 wherein the regions having differing reflectivities comprise microwave-reflective coatings having differing patterning geometries.

22. A microwave susceptor as in claim 19 wherein the regions having differing microwave absorption characteristics comprise microwave absorptive coatings comprising differing materials.

23. A microwave susceptor as in claim 19 wherein the regions having differing microwave absorption characteristics comprise microwave absorptive coatings having differing patterning geometries.

24. A microwave susceptor as in claim 1 having microwave absorptive coatings disposed on opposing surfaces of the substrate.

25. A microwave susceptor as in claim 24 having microwave reflective coatings disposed upon each of the microwave absorptive coatings.

26. A microwave susceptor as in claim 1 having microwave reflective coatings disposed on opposing surfaces of the substrate.

27. A microwave susceptor as in claim 25 wherein the microwave reflective coating disposed on opposing surfaces of the substrate are in phased array.

28. A microwave susceptor as in claim 26 wherein the substrate comprises a polyester film.

29. A microwave susceptor as in claim 26 wherein the substrate comprises a paper or paper laminate.

30. A microwave susceptor as in claim 1 comprising a substrate and a microwave reflective coating disposed thereon, the coating being at least partially removed in a pattern to provide microwave absorptive characteristics in regions where the coating has been removed.

31. A microwave susceptor as in claim 28 wherein the substrate comprises a cellulosic material.

32. A microwave susceptor as in claim 1 comprising at least two substrates that are made of different materials.

33. A package structure for microwave cooking of food, comprising:

a receptacle for holding of food to be cooked;

a microwave susceptor affixed to at least a portion of the receptable, said susceptor optionally in contact with the food, the susceptor comprising:

a) at least one substantially microwave-transparent substrate, the substrate having opposed surfaces;

b) at least one microwave-absorptive coating disposed upon at least one of said opposed surfaces, said microwave-absorptive coating constructed and arranged to absorb microwave energy and generate heat; and c) at least one microwave-reflective coating disposed as a pattern proximate to at least one of said opposed surfaces to thereby reduce the amount of such microwave energy that reaches the microwave-absorptive coating when the susceptor is exposed to a microwave energy field, said microwave-reflective coating constructed and arranged to reflect microwave radiation.

34. A package structure as in claim 33, comprising at least one substrate with one microwave-absorptive coating and one microwave-reflective coating disposed on opposing surfaces thereof.

35. A package structure as in claim 34, wherein at least one of the microwave-absorptive coating and microwave reflective coating comprises a patterned surface.

36. A package structure of claim 33, wherein said microwave-reflective coatings that are disposed proximate to at least one of said opposed surfaces of the substrate are in phased array.

37. A package structure of claim 33, comprising at least two substrates that are made of different materials.

38. A microwave susceptor as in claim 33, wherein the microwave reflective coatings disposed proximate to at least one of said opposing surfaces of the substrate are disposed in a pinwheel pattern.

39. A package structure as in claim 35, wherein said microwave reflective coating is disposed in a pinwheel pattern.

40. A microwave susceptor as in claim 1, wherein said at least one microwave-absorptive coating and said at least one microwave-reflective coating each have a resistivity, said microwave-absorptive coating having a higher resistivity than the resistivity of the microwave-reflective coating.

41. A package structure as in claim 33, wherein said at least one microwave-absorptive coating and said at least one microwave-reflective coating each have a resistivity, said microwave-absorptive coating having a higher resistivity than the resistivity of the microwave-reflective coating.

42. A microwave susceptor for use in food packaging, the susceptor comprising:

(a) at least one substantially microwave-transparent substrate, the substrate having opposed surfaces;

(b) at least one microwave-absorptive coating disposed as a pattern upon at least one of said opposed surfaces; and (c) at least one microwave-reflective coating disposed as a plurality of separate reflective regions separated by nonreflective regions, the coating proximate to at least one of said opposed surfaces, said microwave reflective coating constructed and arranged to reflect an amount of microwave radiation sufficient to prevent heating of the microwave-absorptive coating to a level which leads to deformation and volatilization of the microwave-transparent substrate.

43. The microwave susceptor of claim 42 in which the microwave absorptive coating has a resistivity of between about 30 and about 500 ohms per square.

44. The microwave susceptor of claim 43, wherein the microwave reflective coating has a resistivity less than the resistivity of the microwave-absorptive coating.

* * * * *

UNITED STATES PATENT OFFICE

CERTIFICATE OF CORRECTION

Patent No. 5,185,506 Dated February 9, 1993

Inventor(s) Glenn J. Walters

It is certified that error appears in the above-identified patent and that said Letters Patent is hereby corrected as shown below:

IN THE CLAIMS:

Claim 20, line 1, change "18" to --19--.
Claim 22, line 1, change "19" to --21--.
Claim 23, line 1, change "19" to --21--.
Claim 27, line 1, change "25" to --26--.
Claim 28, line 1, change "26" to --27--.
Claim 29, line 1, change "26" to --27--.
Claim 31, line 1, change "28" to --30--.

Signed and Sealed this

Second Day of November, 199[illegible]

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,185,506

DATED : February 9, 1993

INVENTOR(S) : Glenn J. Walters

It is certified that error appears in the above-identified patent and that said Letters Patent is hereby corrected as shown below:

Fig. 1: change "Time" to --Surface Resistivity/Time--;

Fig. 14: change "T" to --2--;
change "A" to --Average--;
change "R" to --1--;

Fig. 16: change "T" to --2--;
change "A" to --Average--;
change "R" to --1--;

Fig. 18: change "T" to --2--;
change "A" to --Average--;
change "R" to --1--;

Col. 5: line 17, change "12" to --14--;
line 19, change "14" to --12--;

Col. 6: line 32, before "resistivity" insert --surface--;
line 50, before "resistivity" insert --surface--;
line 50, change "10" to --1--;
line 51, change "150" to --15--;
line 58, before "resistivity" insert --surface--;

Col. 12: line 20, change "energy" to --resistivity--;
line 53, change "bulk resistivity or surface energy" to --surface resistivity--;
line 59, change "25" to --2.5--;

Col. 14: line 64, before "resistivity" insert --surface--;
line 67, before "resistivity" insert --surface--;
line 68, change "10 and about 150" to --1 and about 15--;

UNITED STATES PATENT AND TRADEMARK OFFICE

CERTIFICATE OF CORRECTION

PATENT NO. : 5,185,506

DATED : February 9, 1993

INVENTOR(S) : Glenn J. Walters

It is certified that error appears in the above-identified patent and that said Letters Patent is hereby corrected as shown below:

Col. 16: line 46, before "resistivity" insert --surface--;
line 47 (twice), before "resistivity" insert --surface--;
line 51, before "resistivity" insert --surface--;
line 53 (twice), before "resistivity" insert --surface--;

Col. 18: line 4, before "resistivity" insert --surface--; and
line 5, before "resistivity" insert --surface--.

Signed and Sealed this

Nineteenth Day of April, 1994

Bruce Lehman

*Attest:*

*Attesting Officer*

BRUCE LEHMAN

*Commissioner of Patents and Trademarks*